US006077238A

United States Patent [19]

Chung

[11] Patent Number: 6,077,238

[45] **Date of Patent: *Jun. 20, 2000**

[54] MASSAGING APPARATUS WITH MICRO CONTROLLER USING PULSE WIDTH MODULATED SIGNALS

[75] Inventor: Stephen Chung, Taipei, Taiwan

[73] Assignee: HoMedics, Inc., Keego Harbor, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/608,684

[22] Filed: Feb. 29, 1996

[51] Int. Cl.[7] ..... A61H 23/02

[52] U.S. Cl. ..... 601/57; 601/60; 601/70

[58] Field of Search ..... 601/48, 49, 56–60, 601/70

[56] References Cited

U.S. PATENT DOCUMENTS

| | | | |
|---|---|---|---|
| 3,446,204 | 5/1969 | Murphy | 128/33 |
| 3,596,154 | 7/1971 | Gurwicz et al. | 318/52 |
| 3,678,923 | 7/1972 | Oetlinger | 128/33 |
| 4,105,024 | 8/1978 | Raffel | 128/33 |
| 4,110,668 | 8/1978 | Gurwicz et al. | 318/78 |
| 4,232,661 | 11/1980 | Christensen | 601/48 |
| 4,289,997 | 9/1981 | Jung et al. | 318/113 |
| 4,370,602 | 1/1983 | Jones, Jr. et al. | 318/114 |
| 4,447,788 | 5/1984 | Mundt et al. | 318/799 |
| 4,506,201 | 3/1985 | Tsuneki | 318/603 |
| 4,518,900 | 5/1985 | Nawata | 318/102 |
| 4,544,867 | 10/1985 | Jones, Jr. et al. | 318/129 |
| 4,644,232 | 2/1987 | Nojiri et al. | 318/66 |
| 4,749,927 | 6/1988 | Rodal et al. | 318/599 |
| 4,757,245 | 7/1988 | Ayers et al. | 318/685 |
| 4,761,591 | 8/1988 | Hartwig | 318/345 |
| 4,779,615 | 10/1988 | Frazier | 601/47 |
| 4,825,133 | 4/1989 | Tanuma et al. | 318/113 |
| 4,833,375 | 5/1989 | Del Signore, II | 318/269 |
| 4,845,608 | 7/1989 | Gdula | 364/166 |
| 5,007,410 | 4/1991 | DeLaney | 601/57 X |
| 5,188,096 | 2/1993 | Yoo . | |
| 5,437,607 | 8/1995 | Taylor | 601/48 |
| 5,437,608 | 8/1995 | Cutler | 601/49 |
| 5,575,761 | 11/1996 | Hajianpour | 601/48 |

FOREIGN PATENT DOCUMENTS

| | | |
|---|---|---|
| 1991-2972 | 2/1991 | Rep. of Korea . |
| 2167961 | 6/1986 | United Kingdom . |
| 2241894 | 9/1991 | United Kingdom . |

*Primary Examiner*—Danton D. DeMille
*Attorney, Agent, or Firm*—Brooks & Kushman PC

[57] ABSTRACT

A massaging apparatus utilizing a hand held controller includes a microcontroller to actuate a plurality of vibrators positioned within a cushion using pulse width modulated signals. The microcontroller is programmed such that each zone may be actuated independently and continuously, simultaneously and continuously, or sequenced at a selectable rate controlled by the user. The hand held control uses multiplexing of the switch inputs and LED outputs to control twelve LEDs and five vibrating motors via eight switch inputs using a microcontroller having only thirteen I/O lines. A warning timer is also provided to remind the user that the device is turned on at periodic intervals.

6 Claims, 6 Drawing Sheets

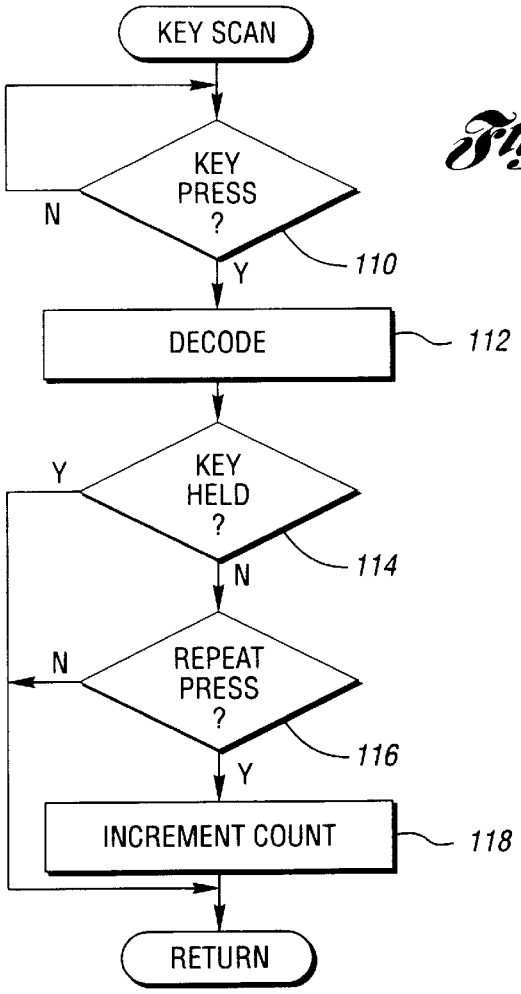
Fig. 9
Fig. 10
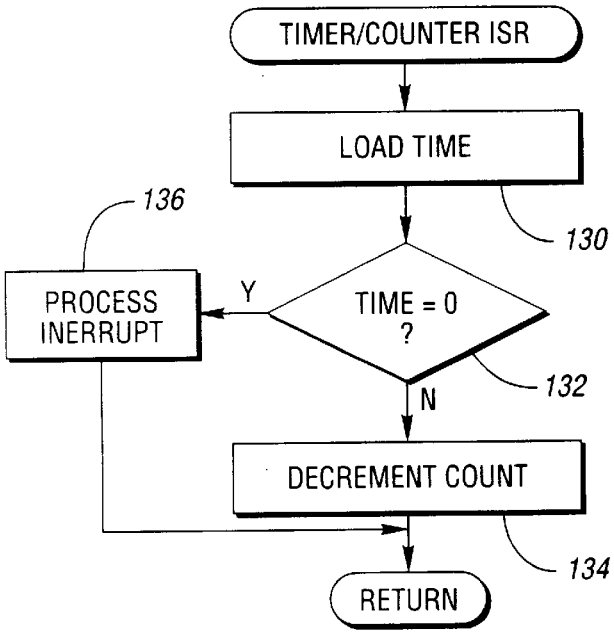
Fig. 11
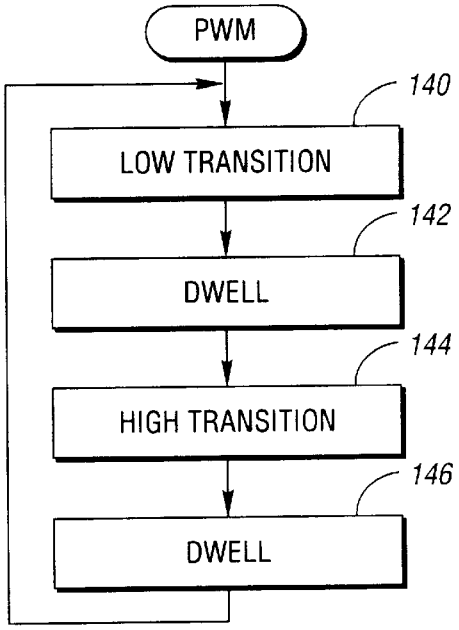

MASSAGING APPARATUS WITH MICRO CONTROLLER USING PULSE WIDTH MODULATED SIGNALS

TECHNICAL FIELD

This invention relates to a massage apparatus having a hand-held controller which incorporates an internal control and an intensity control unit for controlling the rate and duration of energization and the intensity of vibratory energy imparted, respectively, by each of a plurality of vibrators coupled to a cushion structure.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office, patent file or records, but otherwise reserves all copyright rights whatsoever.

BACKGROUND ART

Early massage devices were typically designed as therapeutic chairs, mattresses, and the like wherein one or more vibrating members were embedded therein for imparting vibratory energy to a user. Typically, the vibrating members were placed under a frame, box spring or the like, such that when oscillated, vibratory energy was transmitted through the mattress or cushion structure indirectly. Such movements were typically localized and unappealing. See, for example, U.S. Pat. Nos. 2,924,216, 3,885,554, 5,007,410, 5,050,587, 4,354,067, 4,256,116, 4,005,703, 4,157,088, 4,544,867, 3,678,923 and 4,779,615.

There have been attempts to overcome the aforementioned difficulties by providing vibrating units arranged in selective groups or arrays, the control of which provides the illusion of a rolling or travelling motion to the user. These designs, however, typically incorporate complex electromechanical structures and/or electronics. See, for example, U.S. Pat. Nos. 3,446,204, Re. 31,603, 5,192,304, 5,437,608 and U.K. Patent No. GB 2,256,147A.

One method for providing an illusion of a rolling or traveling motion to the user is disclosed in U.S. Pat. No. 5,437,608 which uses a counter to sequentially actuate each zone or group of vibrating units. This approach, however, is inflexible in that the sequence of operation is fixed. Furthermore, only one group or zone may be actuated at any one time.

Consequently, a need has developed for an improved massage apparatus having a plurality of vibrators coupled to a cushion structure which incorporates a simple hand-held controller for controlling both the rate and duration of energization of each of a plurality of vibrators as well as the intensity of vibratory energy imparted thereby.

SUMMARY OF THE INVENTION

It is a principal object of the present invention to provide a massage apparatus having an improved controller with simplified electronics for controlling the rate and duration of energization and the intensity of vibratory energy, respectively, imparted by each of a plurality of vibrators embedded in a cushion structure.

It is a further object of the present invention to provide massage apparatus of the type referenced above wherein the improved controller incorporates a power control unit operative to generate a plurality of power control signals at timed intervals variable by the user and a variable intensity control unit operative to generate pulse width modulated signals to produce the intensity selected by the user.

A still further object of the present invention is to provide massage apparatus utilizing a microcontroller which allows actuation of one or more vibratory zones based on selection by the user.

Yet another object of the present invention is to provide massage apparatus which utilizes a microcontroller to provide flexibility of design and improved authority of control over a plurality of vibratory zones including the ability to sequentially actuate two or more of the vibratory zones.

In carrying out the above stated objects, there is provided a massage apparatus of the type having a plurality of vibrators coupled to a cushion for imparting vibratory energy thereto and to a user. The invention includes a microcontroller having multiplexed inputs and outputs. The microcontroller generates pulse width modulated signals to generate an effective DC signal for controlling vibration intensity by controlling rotational speed of the vibrator motors. The massage apparatus generates a reminder signal which actuates at least one of the vibrators after a predetermined time interval when the apparatus is turned on but none of the vibratory zones are selected by the user.

In a preferred embodiment, the cushion structure is elongated, foldable and comprised of resilient material. The vibrators coupled thereto are DC motors with eccentric cams with housings carried in the cushion in a fixed, spaced-apart relationship constituting a multiplicity of massage zones across the length of the cushion. The controller is located external to the cushion structure and is adapted to be hand-held.

These and other objects, features and advantages of the present invention are more readily apparent when taken in conjunction with the accompanying drawings.

BRIEF DESCRIPTION OF THE DRAWINGS

FIGS. 6–11 illustrate the operation of the controller of FIGS. 3 and 4.

BEST MODE FOR CARRYING OUT THE INVENTION

Figure 1:
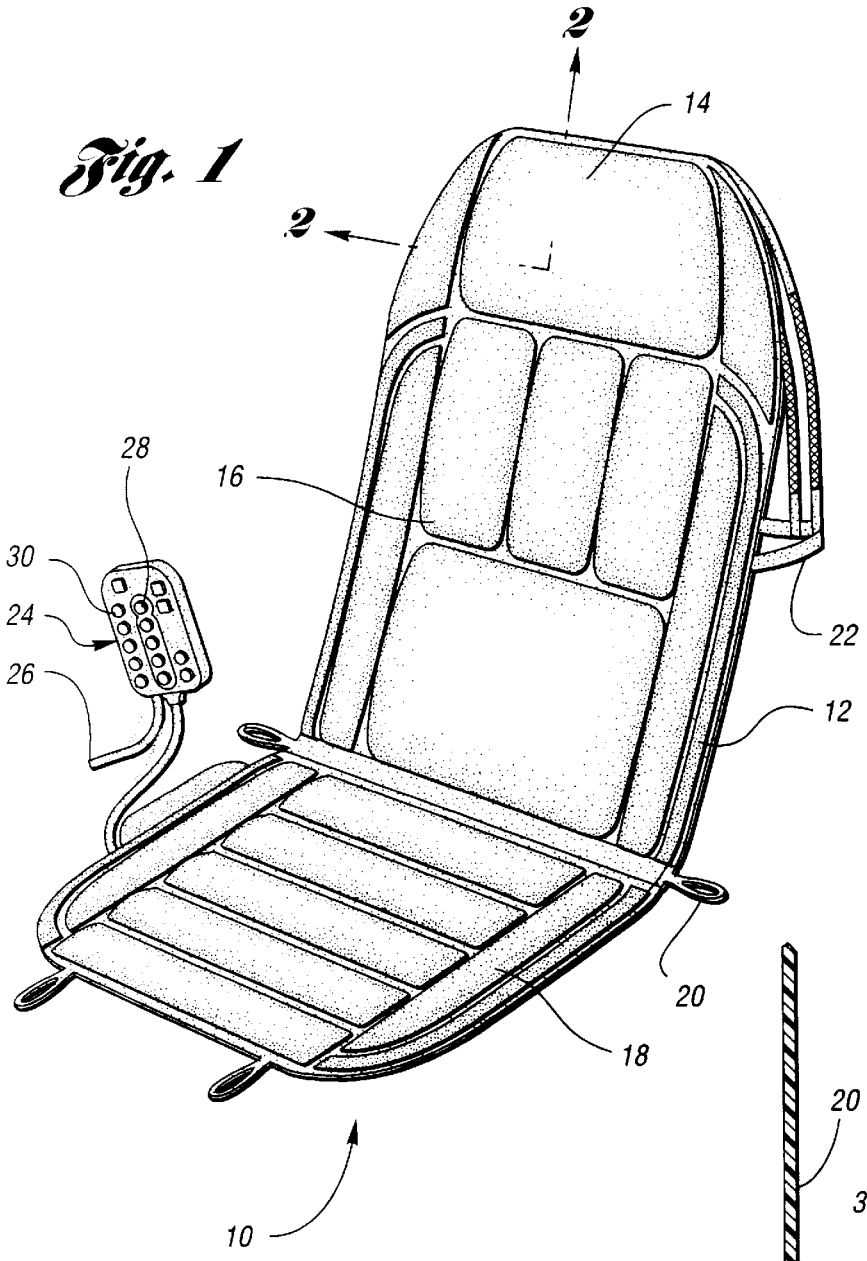
FIG. 1 is a pictorial representation of a massage apparatus according to the present invention.

With reference to FIG. 1 of the drawings, there is shown a schematic diagram of the massage apparatus of the present invention designated generally by reference numeral 10. Massage apparatus 10 is shown as an elongated and foldable pad comprised of a resilient material such as polyurethane, or the like. Apparatus 10 may, of course, be used in many forms such as an upholstered item of furniture, an automobile seat, a chair, or may be a separate cushion, mattress or a pad as shown.

In the schematic of FIG. 1, massage apparatus 10 includes an elongated cushion structure such as pad 12 which may be laid flat or folded as shown for placement on a chair, automobile seat, etc. Apparatus 10 includes a head portion 14, a mid or torso portion 16, and a bottom or seat portion 18 to correspond to head, torso and seat portion, respectively, of a user.

As shown, apparatus 10 includes massage motors or other vibrators in each of the portions. In a preferred embodiment, the torso portion 16 and the seat portion 18 each include two vibrators. Of course, a greater or lesser number of vibrators may be utilized according to the teachings of the present invention.

As also shown in FIG. 1, massage apparatus 10 includes retaining straps such as straps 20, and a positioning web 22 for securing the massage apparatus to a chair, automobile seat, or the like. The massage apparatus 10 also includes a hand held controller 24 which is preferably connected to the seat portion 18 and also adapted for connection to a power source via cord 26. As explained in greater detail herein, the power source is preferably a 12 volt DC source to facilitate operation in an automobile. However, an AC adaptor may also be provided to supply the appropriate power. Hand held control 24 includes a number of indicator lights, such as LED 28, and a number of switches or push buttons 30.

Figure 2:
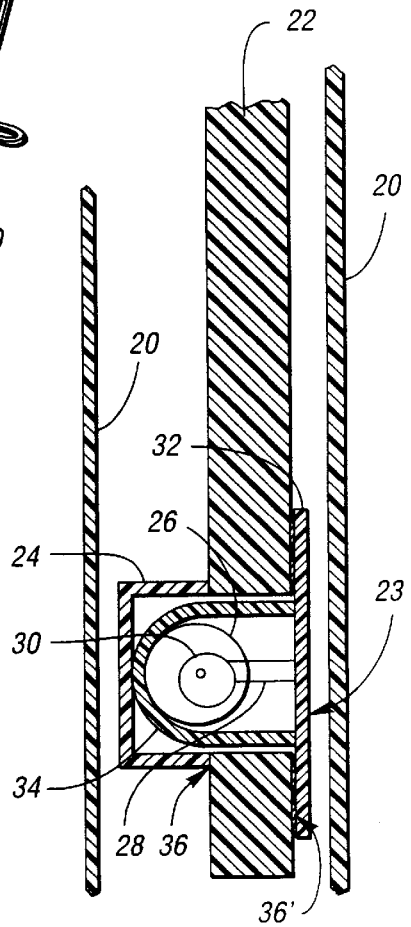
FIG. 2 is a cross-sectional diagram of a massage apparatus according to the present invention shown in FIG. 1.

Referring now to FIG. 2, a partial cross-section of the massage apparatus 10 illustrated in FIG. 1 is shown. A durable, removable cover 20 surrounds a foam core 22 which is preferably accessible via a zipper. Foam core 22 includes an aperture for each vibrator 23 which is covered by a small piece of foam 24 secured to foam 22 via adhesive 36. Vibrator 23 is also secured to foam 22 via adhesive 36'.

With continuing reference to FIG. 2, in a preferred embodiment, vibrator 23 includes a housing having a base plate 32 and a shroud 34 which surround a DC motor 26 supported by tab 28. Preferably, tab 28 is integral to base plate 32 and is bent perpendicular thereto to support motor 26. DC motor 26 includes a cam 30 which is eccentrically mounted to produce vibration when the motor turns. The user will experience various vibrational intensities depending on the speed of rotation of DC motor 26 and cam 30. Such vibrators are well established in the art. Of course, various other vibrating arrangements could be utilized without departing from the spirit or scope of the present invention.

Figure 3:
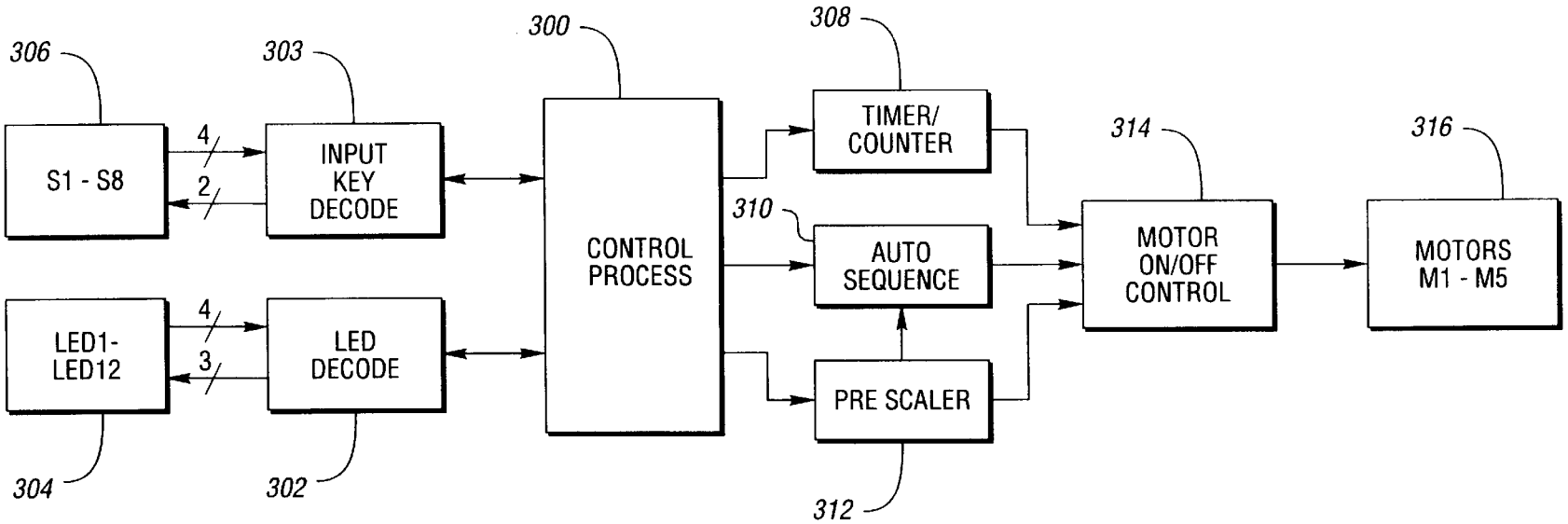
FIG. 3 is a block diagram of the controller of FIG. 1.

Referring now to FIG. 3, a block diagram illustrating control of a massage apparatus according to the present invention is shown. In a preferred embodiment, Control Process 300 is implemented within a microcontroller, such as the FLSS/1299 which is an 8 bit microcontroller implemented in a fully static CMOS design using low power, high speed CMOS technology. Control Process 300 communicates with LED decode block 302 to control 12 LEDs, represented by block 304. However, the control is multiplexed such that only seven data lines are needed as illustrated and described in greater detail with reference to FIG. 4. Control Process 300 also communicates with input key decode block 303 which multiplexes eight switches, represented by block 306. This allows eight inputs to be monitored using only six input lines.

With continuing reference to FIG. 3, control process communicates with a timer/counter 308, an auto sequencer 310, and a prescaler 312. Timer/counter 308 keeps track of a warning interval, preferably about 15 minutes, to remind the user that power is on when none of the motors has been selected by the user. Auto sequencer 310 controls sequencing through selected vibrator motors when the automatic sequencing mode is selected by the user. Prescaler 312 is used to control the speed of the auto sequence block 310 in addition to the intensity of the vibrator motors. The prescaler provides selectable divisors which are applied to the system clock signal to generate a lower frequency periodic signal.Intensity is controlled using pulse width modulated signals as illustrated and described in detail with reference to FIGS. 5*a*–5*c*. Timer/counter 308, auto sequencer 310 and prescaler 312 communicate with motor on/off control 314 to control motors M1–M5, represented by block 316. In a preferred embodiment, the user may select which of the five portions or zones of the massage apparatus to be actuated, whether to continuously actuate the selected zones or automatically sequence through them, the strength or intensity of vibration, and the speed of cycling.

Figure 4:
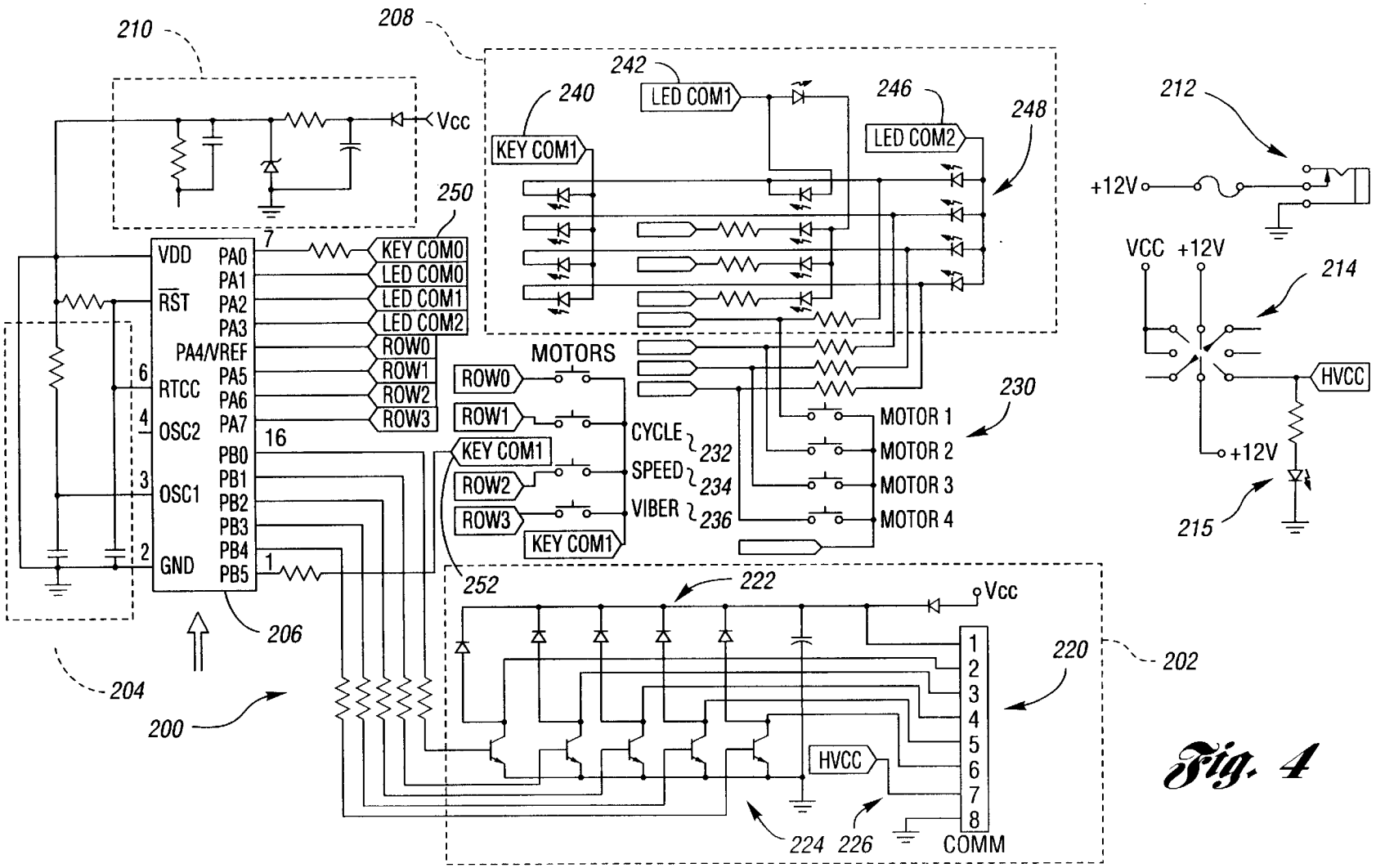
FIG. 4 is a circuit schematic of the control for the massage apparatus of FIG. 1.

Referring now to FIG. 4, a circuit schematic is shown illustrating the control of a massage apparatus according to the present invention. Preferably, all of the components illustrated in FIG. 4 reside on a printed circuit board disposed within hand controller 24. Control circuit 200 includes a DC motor driver circuit 202 which converts signals received from microcontroller 206 into acceptable signals to drive the DC motors 26 disposed within massage apparatus 10. An oscillator circuit 204 is connected to microcontroller 206 and includes components such as resistor R14 and capacitor C3 to produce an input oscillation frequency of about 2 MHz. An indicator output circuit 208 is used to provide an indication to the user of the current operating mode. Control circuit 200 also includes a power conditioning circuit 210 which filters and regulates the power input to microcontroller 206. Preferably, the input voltage, $V_{dd}$ is regulated at about 5.1 volts by zener diode D21.

With continuing reference to FIG. 4, control circuit 200 includes a fuse and a power jack connector, indicated generally by reference numeral 212. A power switch 214 is provided, which is preferably a three position sliding switch having positions for off, on, and heat. In a preferred embodiment, heat is provided to all zones of massage apparatus 10 when sliding switch SW1 is positioned to select heat. LED 215 provides an indication to the user that the massage apparatus 10 is on and heat has been selected. Circuit 202 includes a connector terminal 220 so that hand held controller 24 may be disconnected from the cushion mat. Circuit 202 includes a number of diodes 222 connected to corresponding transistors 224. The transistors receive signals from the microcontroller 206 and provide a ground signal for their corresponding motors which are connected to pins 2–6 of terminal 220. Pin 1 of terminal 220 provides power to all five of the motor vibrators.

Circuit 208 includes twelve indicator lights or LEDs which are controlled by microcontroller 206. As illustrated, the indicators 248 are multiplexed using three common lines 240, 242, and 246 and four individual signal lines, ROW0–ROW3. These individual lines are also connected to switches S1–S8 which have corresponding common lines, such as common line 252. The descriptions for the microcontroller pins illustrated in FIG. 4 are set forth below in Table 1.

TABLE 1

MICROCONTROLLER PIN DESCRIPTIONS

| Pin Name | I/O | Description |
|---|---|---|
| PA7–PA0 | I/O | Port A<br>PA3–PA0: TTL input levels or comparator input PA7–PA4: TTL input levels |
| PB5–PB0 | I/O | Port B, TTL input levels |
| CNTI | I | Counter input, Schmitt trigger input levels |
| VREF | I | Comparator VREF input |
| /ERST | I | External reset input pin |
| OSC1 | I | Oscillator input |
| OSC2 | O | Oscillator output |
| VDD | | Power |
| GND | | Ground |

Figure 5A:
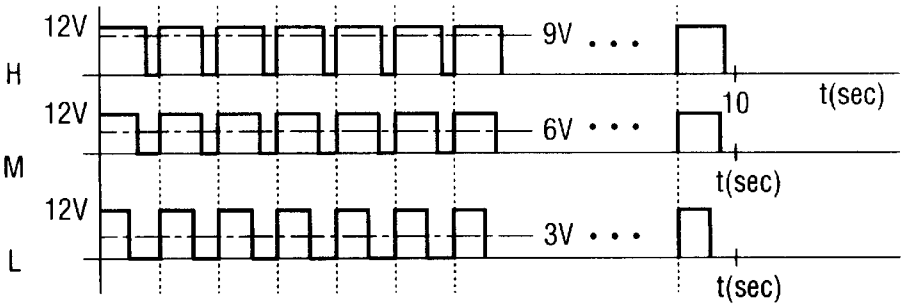
FIGS. 5*a*–5*c* are a pictorial illustration of representative signals of the controller of FIG. 4.
Figure 5B:
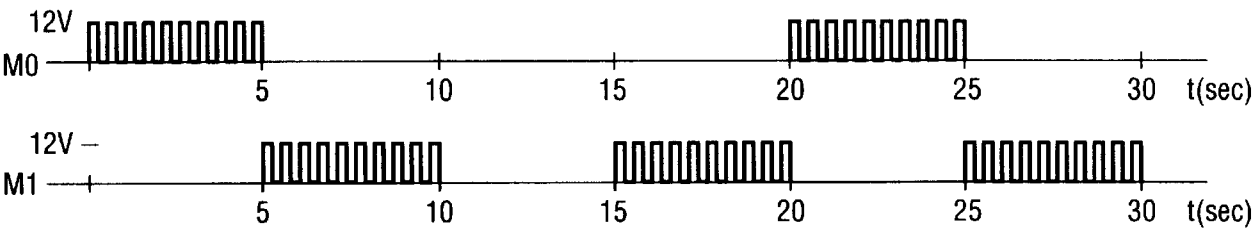
Figure 5C:
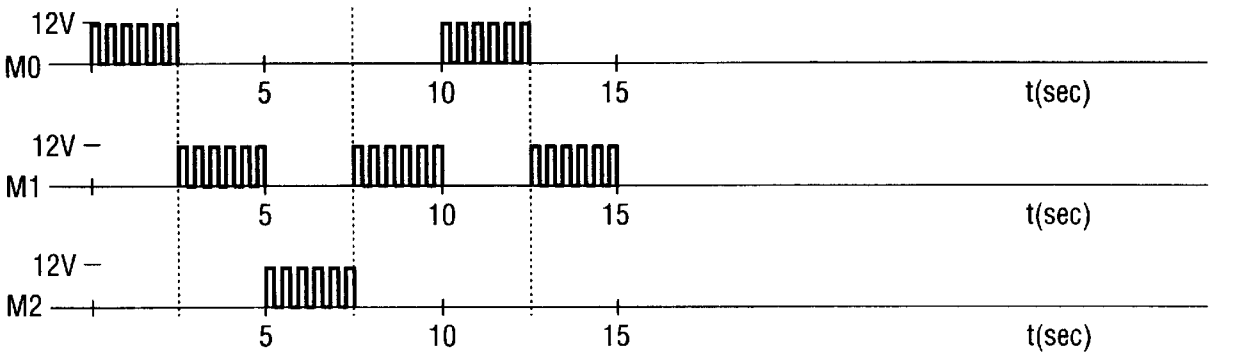
Figure 6:
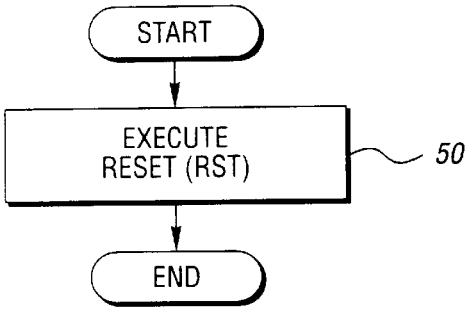

FIGS. 5*a*–5*c* illustrate representative signals produced to control the vibrating motors of massage apparatus 10. FIG. 5*a* represents a continuous actuation signal for three different levels of vibration. The high signal, indicated by H is a pulse train having a duty cycle of approximately 97%. The pulse train is a series of substantially rectangular pulses which are sent to one or more of the vibrator motors as selected by the user. As illustrated, regardless of whether the user selects high, medium, or low vibration intensity, the rectangular pulses go from about 0 volts to the supply voltage which is about 12 volts in a preferred embodiment. By varying the duty cycle of the pulse train, the effective DC voltage seen by the various vibrator motors changes as indicated by the broken lines which alters the average motor speed accordingly. The pulse width modulated signal is produced by two timers within the microcontroller which represent the time period that the pulse is high, and the time period that the pulse is low, respectively.

FIG. 5*b* illustrates representative signals during the automatic sequencing mode of the present invention. Although, only three motor signals are illustrated, the concept is easily extendable to five or more motors. As illustrated, the motors are sequentially energized in an alternating pattern such that only one motor is energized during a particular time interval. The time interval is controlled by the cycling speed selected by the user. In a preferred embodiment, three cycling speeds are available. The cycling speed is independent of the vibration intensity which is controlled by the duty cycle, or pulse width of the signals. Similarly, the present invention provides for alternating sequential operation among selected motors. For example, the first, fourth and fifth motors may be selected by the user. During auto sequencing, motor 1 is actuated for a first time period, followed by motor 4, motor 5, motor 4, motor 1, etc.

FIG. 5*c* illustrates representative signals for auto sequencing using a faster sequencing speed (shorter time interval). The auto sequencing pattern continues until deselected by the user via a cycle push button. As illustrated in FIGS. 5*a*–5*c*, the rectangular pulse trains always swing from about 0 volts to the level of the power supply regardless of the vibration intensity or the sequencing speed.

Figure 7:
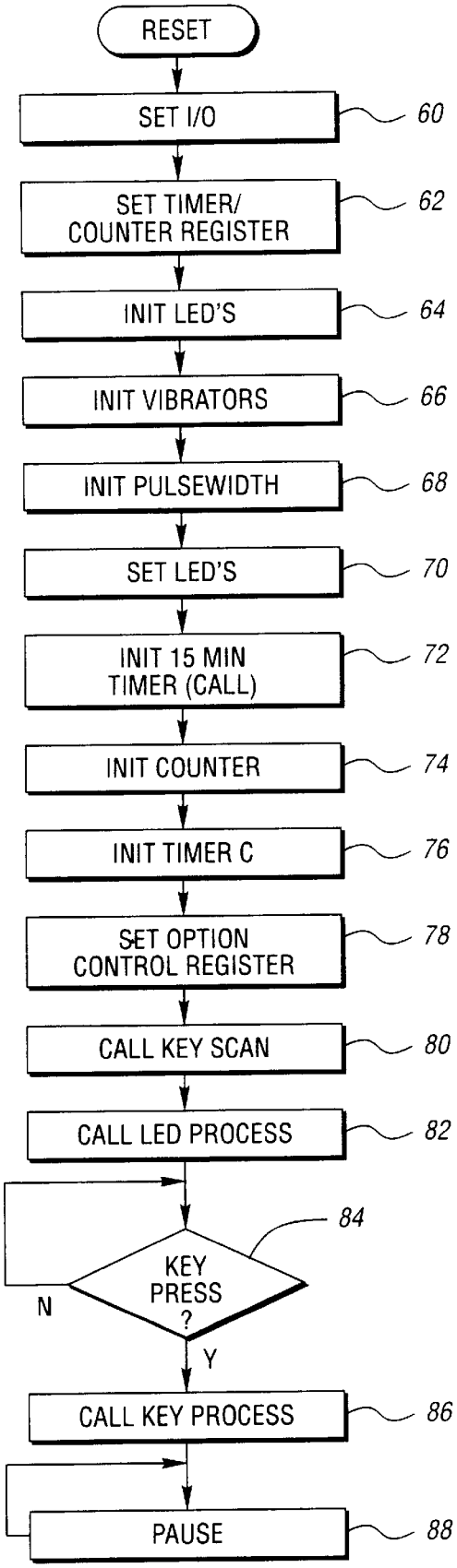

Referring now to FIGS. 6–11, flow charts illustrating operation of the control program within microcontroller 206 are shown. As indicated by block 50 of FIG. 6, when power is applied to the system, a reset program is executed. The reset program is illustrated in FIG. 7. Block 60 of FIG. 7 initializes the data ports of the microcontroller (Port A and Port B). These data ports are configurable as inputs or outputs depending on the content of the corresponding control registers. Preferably, pins PA0–PA3 and PB0–PB5 are configured as outputs while pins PA4–PA7 are configured as inputs. As such, the present invention uses multiplexing techniques to control seventeen outputs (twelve LEDs and five vibrator motors) via eight selector switches (momentary contact push buttons) using only ten outputs and four inputs of the microcontroller.

Block 62 of FIG. 7 sets the timer/counter register which is used to periodically generate an interrupt. Blocks 64, 66, and 68 represent initialization of the LEDs, vibrators, and pulse width memory locations, respectively. These blocks essentially clear the memory locations to eliminate the possibility of any spurious operation. Block 70 illuminates the default LEDs. For example, when power is applied to the system, the "low" cycle speed LED is illuminated in addition to the "low" vibration intensity LED.

Block 72 initializes the fifteen minute timer using a subroutine call. This timer is used to generate a user warning or reminder indicating that the system is on but that no vibrator motors have been selected. In a preferred embodiment, this reminder actuates the vibrator motor located at the lower torso for approximately ten seconds with a "medium" intensity level.

Blocks 74, 76, and 78 perform additional initialization functions. Block 80 calls the key scan subroutine which is responsible for decoding the push button inputs. Block 82 calls the LED processing subroutine which is responsible for decoding the LED outputs to illuminate the appropriate LEDs.

Block 84 determines whether any of the push buttons have been depressed while block 86 calls the key processing subroutine to take appropriate action based on the key or keys which have been depressed. Block 88 is an infinite loop which essentially ends execution of the reset routine until an interrupt is generated.

Figure 8:
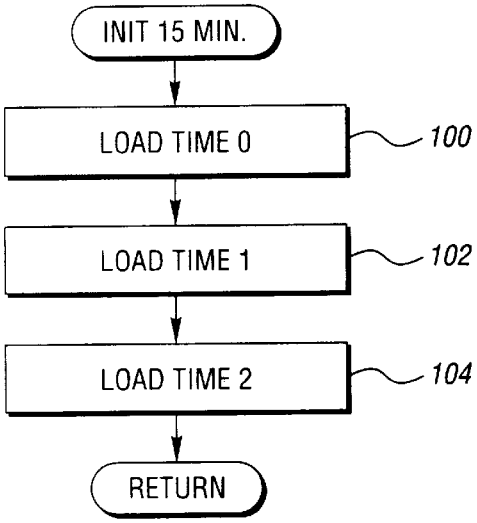

FIG. 8 illustrates a simple initialization routine which loads appropriate values into three different timers as indicated by blocks 100, 102, and 104. These timers control the interval between the warning or reminder actuation of the torso vibrator motor, as well as the duration and intensity of the reminder signal. For example, in a preferred embodiment, block 100 loads a first timer with a value corresponding to a timer of about fifteen minutes. Block 102 loads a second timer with a value corresponding to the duration of the reminder signal which is about ten seconds. Block 104 loads a third timer with a value representing the vibration intensity, i.e. the pulse width, which corresponds to a medium intensity or a duty cycle of about 78%.

Referring now to FIG. 9, a key scan routine is illustrated. Block 110 determines whether a push button has been depressed. Block 112 decodes the signal to determine which of the push buttons has been depressed based on the two signal lines corresponding to one of ROWS 0–3 and common lines COM0 and COM1. Block 114 determines whether the push button is being continuously held down in which case the routine is exited and control is returned to the calling routine. Block 116 determines whether there has been a repeat key press by maintaining a memory location which may be incremented to advance the system to the subsequent state. For example, when power is applied to the system, the vibration intensity defaults to "low". The first press of the intensity push button advances the intensity to the "medium" state. Subsequent depressions of the intensity push button will cycle through the available states from "low" to "medium" to "high" and then back to "low". Cycle speed selection for auto sequencing mode is performed in a similar fashion. The incrementing and resetting function to cycle through the appropriate states is represented by block 118 of FIG. 9.

Referring now to FIG. 10, the timer/counter interrupt subroutine is illustrated. This controls the functioning of the warning or reminder signal as described above. At block 130, the current timer is loaded. Block 132 determines when the timer interval has expired in which case block 136 calls another interrupt service routine. Otherwise, block 134 decrements the count and control is returned to the calling routine.

Referring now to FIG. 11, a pulse width modulation routine is illustrated. Block 140 represents various "housekeeping" tasks which may be required to save the contents of registers which are used to produce the PWM signal. Block 142 represents the dwell time for the low or off state of the vibrator motor. Block 144 represents the various register moves to accomplish the transition from the low to the high state. Similarly, block 146 represents the dwell time for the high or on state of the vibrator motor. This process is repeatedly executed to produce a train of rectangular pulses.

Table 2 provides a memory map for microcontroller 206. This map is particularly useful when interpreting the assembly language program reproduced in its entirety herein.

TABLE 2

| MICROCONTROLLER MEMORY MAP | |
|---|---|
| 00 | Indirect addressing register |
| 01 | Program counter, low byte (PCL) |
| 02 | Program memory segment register |
| 03 | Status register |
| 04 | Memory index register (MIR) |
| 05 | Timer/counter register |
| 06 | Timer/counter control register |
| 07 | Port A (PA) data register (Inputs/Outputs) |
| 08 | Port B (PB) data register (Outputs) |
| 09 | Non-implemented |
| 0A | Port A control register (PAC) |
| 0B | Port B control register (PBC) |
| 0C | Non-implemented |
| 0D | Port A interrupt control register |
| 0E | Option control register |
| 0F | Reserved |
| 10–2F | Internal RAM |
| 000–3FF | Program memory |
| 000 | Power-on or external reset starting address |
| 004 | Watchdog timer time-out interrupt starting address |
| 008 | Timer/counter interrupt starting address |
| | Port A interrupt starting address |

As illustrated, the microcontroller includes 13 special purpose registers, 32 bytes of internal Random Access Memory (RAM), and three interrupt sources. In a preferred embodiment, only two of the three available interrupt sources are utilized. The instructions and data corresponding to the flow charts of FIGS. 6–11 and the assembly language program listing are stored within the microcontroller at locations indicated in the memory map.

Assembly Language Listing

The assembly language program listing for a preferred embodiment of the present invention is reproduced in its entirety on the following pages.

```
                ;RC OSC 2MHZ SYSTEM CLOCK=500K
                ; RTCC INT=1K=1.024MS
                ; 15 MIN=900 SEC.
                ;TIM0=59                          ;0.16384s
                ;TIM1=106=47872      ;47872       ;27.525120s
                ;TIM2=13=851968      ;48032       ;872.41523s
                ; *************
                ; 10 SEC =10000
                ;TIM0=16
                ;TIM1=39=9984
                ;TIM2=0
tccr_val        EQU     11000000b
                ;*************************
key_val         EQU     20h
vib_1_def0      EQU     136     ;640=2.5     =1.5
vib_1_def1      EQU     1       ;640=2.5     =1.5
                ;*************************
vib_m_def0      EQU     35      ;800=3.125
vib_in_def1     EQU     0       ;800=3.125
                ;***************************
vib_h_def0      EQU     210     ;980=3.82
vib_h_def1      EQU     0       ;980=3.82
                ;*****************************
rnd_h_def       EQU     050h
                ;*****************************
spd_l_def       EQU     04h
spd_m_def       EQU     02h
spd_h_def       EQU     01h
```

-continued

```
                ;****************************
IDR             EQU     0
MP              EQU     1
                ;*************
flig            EQU     0AH
cf              EQU     0
zf              EQU     2
                ;*********************
RTCC            EQU     0DH             ;
TMRC            EQU     0EH             ;
                ;********************
;PA             equ     12h
ky_cm0          EQU     0
led_cm0         EQU     1
led_cm1         EQU     2
led_cm2         EQU     3
row0            EQU     4
row1            EQU     5
row2            EQU     6
row3            EQU     7
                ;**********************
;pb             EQU     14h
motr0           EQU     0
motr1           EQU     1
motr2           EQU     2
motr3           EQU     3
motr4           EQU     4
ky_cm1          EQU     5
                ;**********************
;PC             EQU     16h
;motr4          equ     0
KY_2XS          EQU     1
                ;*************************
led_ar0         EQU     40h
led0            EQU     0
led1            EQU     1
led2            EQU     2
led3            EQU     3
led4            EQU     4
spd_l0          EQU     5
spd_m0          EQU     6
spd_h0          EQU     7
                ;******************
led_ar1         EQU     41h
vib_l0          EQU     0
vib_m0          EQU     1
vib_h0          EQU     2
pwr_led         EQU     3
com0            EQU     4
com1            EQU     5
com2            EQU     6
                ;******************
tim0            EQU     42h
tim1            EQU     43h
tim2            EQU     44h
                ;******************
flag            EQU     45h
old_key         EQU     0
key_ok          EQU     1
cyc_on          EQU     2
out_fg          EQU     3
shf_fg          EQU     4
led_off         EQU     5
led_one         EQU     6
rand_fg         EQU     7
                ;******************
tmp0            EQU     46h
tmp1            EQU     47h
                ;******************
key_buf         EQU     49h
key_dat         EQU     4Ah
KEY_CNT         EQU     4Bh
                ;******************
spd_cnt         EQU     4ch
spd_cst         EQU     4dh
cyc_rol         EQU     4eh
cyc_tab         EQU     4fh
max_rol         EQU     50h
                ;******************
```

-continued

```
stp__cnt        EQU     51h
                ;*******************
VIB__VOL        EQU     52h
vib__voh        EQU     53h
rtc__hi         EQU     54h
INTVR           EQU     55H
;*******************
pw__ram0        EQU     5bh
PW__RAM1        EQU     5ch
                ;*********************
acctmp          EQU     5fh
                ;*********************
                ORG     0h
                JMP     RST
                ORC     4h
                MOV     A,00000101B
                MOV     INTC,A
                RETI
                ORG     8h
rtc__intr:
                CLR     [TMRC]
                clr     [rtcc]
                MOV     ]ACCTMP],A
                MOV     A,[RTC__HI]
                OR      A,0
                SZ      [FLIG].ZF
                JMP     proc__int
                dec     [RTC__HI]
                MOV     A,10010000B
                MOV     [TMRC],A
                MOV     A,00000101B
                MOV     INTC,A
                MOV     A,[ACCTMP]
                reti
;*************************
proc__int:
                MOV     A,[STP__CNT]
                OR      A,0
                SZ      [FLIG].ZF       ;TIME END ?
                JMP     pwr__prc        ;YES
                SDZ     [TIM0]
                JMP     pwr__pr
                ;**********************
                SNZ     [FLAG].cyc__on
                JMP     CHK__TIM
                SDZ     [SPD__CST]
                JMP     chk__tim
                MOV     A,[SPD__CNT]
                MOV     [SPD__CST],A
                ;**********************
                SNZ     [FLAG].led__one
                JMP     chkledo
                MOV     A,00011111b
                AND     A,[LED__AR0]
                MOV     [CYC__TAB],A
                JMP     chk__tim
chkledo:
                SNZ     [FLAG].led__off
                JMP     chk__upd
                CLR     [CYC__TAB]
                JMP     pwr__prc
                ;*************************
chk__upd:
                SZ      [FLAG].shf__fg
                JMP     dw__lop
                JMP     up__lop
chg__up:
                CLR     [FLAG].shf__fg
                MOV     A,1h
                MOV     [CYC__TAB],A
up__lop:
                INC     [CYC__ROL]
                MOV     A,[CYC__ROL]
                MOV     A,5
                SZ      [FLIG].cf
                JMP     chg__down
                CLR     [FLIG].CF
                RLC     [CYC__TAB]
                ;*********************
```

-continued

```
                MOV     A,[CYC__ROL]
                SUB     A,[MAX__ROL]
                SNZ     [FLIG].CF       ;;;;;;;;;;;;;;;;;
                JMP     up__lop
                ;*****************
                MOV     A,[led__ar0]
                AND     A,00011111b
                AND     A,[CYC__TAB]
                SZ      [FLIG].ZF
                JMP     up__lop
                JMP     save__max
                ;******************
chg__down:
                SET     [FLAG].shf__fg
                MOV     A,10h
                MOV     [CYC__TAB],A
dw__lop:
                SDZ     [CYC ROL]
                JMP     LOW__CYC
                JMP     chg__up
                ;********************
low__cyc:
                CLR     [FLIG].CF
                RRC     [CYC TAB]
                ;****************
                DECA    [CYC__ROL]
                SUB     A,[MAX__ROL]
                SZ      [FLIG].CF       ;;;;;;;;;;;;
                JMP     dw__lop
                ;**************
                MOV     A,[led__ar0]
                AND     A,00011111b
                AND     A,[CYC#TAB]
                SZ      [FLIG].ZF
                JMP     dw__lop
save__max:
                MOV     A,[CYC__ROL]
                MOV     [MAX__ROL],A
                ;********************
chk__tim:
                SDZ     [TIM1]
                JMP     pwr__prc
                SDZ     [TIM2]
                JMP     pwr__prc
                SDZ     [STP__CNT]
                JMP     waron
                ;********* WARANG OFF
                SET     [FLAG].led__off
                CLR     [FLAG].cyc__on
                CLR     [led__ar0]
                ANDM    A,PB
                JMP     int__rets
                ;******************
waron:
                SNZ     [STP__CNT].0
                JMP     set15m
                ;******** RUN 10S
                SET     [LED ARO].motr2
                CLR     [FLAG].led__off
                SET     [TIM2].0
                MOV     A,60
                MOV     [TIM1],A
                MOV     A,16
                MOV     [TIM0 ,A
                JMP     int__rets
set15m:
                CALL    init15m
                CLR     [led__ar0]
                CLR     [FLAG].cyc__on
                SET     [FLAG].led__off
                JMP     int__rets
                ;******************
pwr__prc:
                MOV     A,led__ar0
                SZ      [FLAG].cyc__on
                MOV     A,CYC__TAB
                MOV     [MP],X
                MOV     A,100000b
                SNZ     [FLAG].out__fg
```

-continued

```
out__1:
        JMP     out__h
        CLR     [FLAG].out__fg
        ANDM    A,PB
        MOV     A,[VIB__VOH]
        MOV     [RTC__HI],A
        MOV     A,[VIB__VOL]
        JMP     int__ret
out__h:
        SET     [FLAG].out__fg
        SNZ     [FLAG].led__off
        JMP     out__lev
        ANDM    A,PB
        JMP     int__rtc
out__lev:
        MOV     A,011111b
        AND     A1[IDR]
        ORM     A,PB
int__rtc:
        CPLA    [VIB__VOH]
        and     A,00000011b
        MOV     [RTC__HI],A
        CPLA    [VIB__VOL]
int__ret:
        SNZ     PB.4
        CLR     PC.0
        SZ      PB.4
        SET     PC.0
        MOV     [rtcc],A
int__rets:
        MOV     A,10010000B
        MOV     [TMRC],A
        MOV     A,00000101B
        MOV     INTC,A
        MOV     A,[ACCTMP]
        SNZ     [FLAG].out__fg
        RETI
        JMP     loop            ;3/30
          ;******************
scan__ky:
        MOV     A,11110000b
        MOV     pac,A
        CLR     pa
        CLR     PCC.KY__CMS
        CLR     PC.ky__cmS
        NOP
        NOP
        CPLA    PA
        AND     A,0f0h
        SZ      [FLIG].ZF
        JMP     no-key
; *************************
        SZ      [FLAG].old__key
        JMP     out__key
        SZ      [FLAG].key__ok
        JMP     out__key
        CLR     [KEY__BUF]
        INC     [KEY__BUF]
        SNZ     PA.row0
        JMP     chk__com
        INC     [KEY__BUF]
        SNZ     PA.row1
        JMP     chk__com
        INC     [KEY__BUF]
        SNZ     PA.row2
        JMP     chk__com
        INC     [KEY__BUF]
        SNZ     PA.row3
        JMP     chk__com
          ;*************************
no__key:
        SNZ     [FLAG].old__key
        JMP     re__load
          ;*****************************
clr__key:
        SDZ     [KEY__CNT]
        JMP     out__key
        CLR     [FLAG].old__key
        CLR     [KEY__DAT]
```

-continued

```
;*********************************
re__load:
        MOV     A,key__val
        MOV     [KEY__CNT],A
out__key:
        SET     pac.ky__cm0
        SET     pcc.ky__cmS
        RET     A,00h
          ;******************
chk__com:
        SET     PC.ky__cmS
        NOP
        CPLA    PA
        AND     A,0f0h
        SNZ     [FLIG].ZF
        JMP     rep__ky
        SET     PA.ky__cm0
        CLR     PC.ky__cmS
        MOV     A,04h
        ADDM    A,[KEY__BUF]
        CPLA    PA
        AND     A,0f0h
        SZ      ]FLIG].ZF
        JMP     scan__ky
          ;*********************
rep__ky:
        MOV     A,[KEY__BUF]
        SUB     A,[KEY__DAT]
        SNZ     [FLIG].ZF
        JMP     ner__ky
        SDZ     [KEY CNT]
        JMP     out__key
          ;****KEY READ OK
        SET     [FLAG].old__key
        SET     [FLAG].key__ok
        MOV     A,0bh
        XOR     A,[KEY__DAT]
        SZ      [FLIG].ZF
        MOV     [KEY__DAT],A
        JMP     re__load
ner__ky:
        MOV     A,[KEY__BUF]
        MOV     [KEY__DAT],A
        JMP     re__load
          ;******************
key__prc:
        CLR     [FLAG].key__ok
        SNZ     [LED__AR1].pwr__led
        RET     A,0
        DEC     [KEY__DAT]
        CLR     [FLIG].CF
        RLCA    [KEY__DAT]
;*************************
        ADDM    A,PCL
        MOV     A,00000001b
        JMP     tog__motr
        MOV     A,00000010b
        JMP     tog__motr
        MOV     A,00000100b
        JMP     tog__motr
        MOV     A,00001000b
        JMP     tog__motr
        MOV     A,00010000b
        JMP     tog__motr
        NOP
        JMP     cyc__prc
        NOP
        JMP     cyc__tog
        NOP
        JMP     vib__prc
          ;*************************
cyc__tog:
        MOV     A,00000100b
        XORM    A,[FLAG]
        SZ      [FLAG].cyc__on
        JMP     initspd
        CALL    init15m
        CLR     [led__ar0]
        MOV     A,4
```

-continued

```
        MOV     [STP_CNT],A
        RET     A,0
initspd:
        MOV     A,01111111b
        ORM     A,[led_ar0]
        MOV     A,spd_l_def
        MOV     [SPD_CNT],A
        MOV     [SPD_CST],A
        MOV     A,1
        MOV     [CYC_TAB],A
        CLR     [CYC_ROL]
        CLR     [MAX_ROL]
        SZ      [FLAG].led_off
        CALL    initl5m
        CLR     [FLAG].led_off
        CLR     [FLAG].led_one
        MOV     A,5
        MOV     [STP_CNT],A
        SZ      [LED_AR1].vib_l0
        MOV     A,vib_l_defo
        SZ      [LED_AR1].vib_m0
        MOV     A,vib_m_def0
        SZ      [LED_AR1].vib_h0
        MOV     A,vib_h_def0
        MOV     [VIB_VOL],A
        SZ      [LED_AR1].vib_l0
        MOV     A,vib_l_def1
        SZ      [LED_AR1].vib_m0
        MOV     A,vib_in_def1
        sz      [LED_AR1].vib h0
        MOV     A,vib_h_def1
        MOV     [VIB_VOH],A
        JMP     chk_spdh
          ;*************************
vib_prc:
        SNZ     [LED_AR1].vib_l0
        JMP     chk_vibm
        CLR     [LED_AR1].vib_l0
        SET     [LED_AR1].vib_m0
        CLR     [LED_AR1].vib_h0
        MOV     A,vib_m_def0
        MOV     [VIB_VOL],A
        MOV     A,vib_m_def1
        MOV     [VIB_VOH],A
        RET     A,0
chk_vibm:
        SNZ     [LED_AR1].vib_m0
        JMP     chk_vibh
        CLR     [LED_AR1].vib_l0
        CLR     [LED_AR1].vib_m0
        SET     [LED_AR1].vib_h0
        MOV     A,vib_h_def0
        MOV     [VIB_VOL],A
        MOV     A,vib_h_def1
        MOV     [VIB_VOH],A
        RET     A,0
chk vibh:
        SET     [LED_AR1].vib_l0
        CLR     [LED_AR1].vib_m0
        CLR     [LED AR1].vib_h0
        MOV     A,vib_l_def0
        MOV     [VIB_VOL],A
        MOV     A.vib_l_def1
        MOV     [VIB_VOH],A
        RET     A,0
          ;*************************
cyc_prc:
        SNZ     ]FLAG].cyc_on
        RET     A,0
cycle_on:
        SNZ     [LED_AR0].spd_l0
        chk_spdm
        CLR     [LED_AR0].spd_l0
        SET     [LED_AR0].spd_m0
        CLR     [LED AR0].spd_h0
        MOV     A,spa_m_def
        MOV     [SPD_CNT],A
        RET     A,0
chk_spdm:
```

-continued

```
        SNZ     [LED_AR0].spd_m0
        JMP     chk_spdh
        CLR     [LED_AR0].spd_l0
        CLR     [LED_AR0].spd_m0
        SET     [LED_AR0].spd_h0
        MOV     A,spd_h_def
        MOV     [SPD_CNT],A
        RET     A,0
chk_spdh:
        SET     [LED_AR0].spd_l0
        CLR     [LED_AR0].spd_m0
        CLR     [LED_AR0].spd_h0
        MOV     A,spd_l_def
        MOV     [SPD_CNT],A
        RET     A,0
          ;****************
tog_motr:
        XORM    A,[led_ar0]
        MOV     A,00011111b
        AND     A,[LED_AR0]
        MOV     [TMP0],A
        MOV     A,5
        MOV     [TMP1],A
        MOV     A,0
par_lop:
        RRC     [TMPO]
;*******************
        SZ      [FLIG].cf
        ADD     A,1
        SDZ     [TMP1]
        JMP     par_lop
        MOV     [TMP0],A
        OR      A,0
        SNZ     [FLIG].ZF
        JMP     no_zear
          ;******************
          ; LED OFF
        SZ      [FLAG].led_off
        JMP     nex_prc
        SET     [FLAG].led_off
        MOV     A,4
        JMP     NEX_PRC4
          ;*******************
no_zear:
        SNZ     [FLAG].led_off
        JMP     nex_prc
        CLR     [FLAG].led_off
        MOV     A,5
NEX_PRC4:
        MOV     [STP_CNT],A
        CALL    init15m
          ;*******************
nex_prc:
        CLR     [FLAG].led_one
        DEC     [TMP0]
        SZ      [FLIG].ZF
        SET     [FLAG].led_one
        RET     A,0
          ;*******************
led_prc:
        MOV     A,11110001b
        MOV     PA,A
        CLR     PAC
        SZ      [LED_AR1].com0
        JMP     chk_com2
        SET     [LED_AR1].com0
        CLR     [LED_AR1].com1
        SET     PA.led_cm0
        SWAPA   [LED_AR0]
        JMP     out_led
chk_com2:
        SZ      [LED_AR1].com1
        JMP     chk_com3
        SET     [LED_AR1].com1
        CLR     [LED_AR1].com2
        SET     PA.led_cm1
        MOV     A,[led_ar0]
        JMP     out_led
chk_com3:
```

-continued

```
            SET     [LED_AR1].com2
            CLR     [LED_AR1].com0
            SET     PA.led_cm2
            SWAPA   [LED_AR1]
              ;*****************
out_led:
            XOR     A,0f0h
            OR      A,0fh
            ANDM    A,PA
            RET     A,0
              ;*************
init15m:
            MOV     A,60
            MOV     [TIM0],A
            MOV     A,106
            MOV     [TIM1],A
            MOV     A,14
            MOV     [TIM2],A
            RET     A,0
              ;*****************
RST:
            MOV     A,11110000b
            CLR     PA
            MOV     PAC,A
;************************
            CLR     PB
            CLR     PBC
;************************
            MOV     A,11111110B
            MCV     PCC,A
            CLR     PC
;************************
            CLR     [FLAG]
            SET     [FLAG].led_off
            CLR     [led_ar0]
            CLR     [led_ar1]
            MOV     A,vib_l_def0
            MOV     [VIB_VOL],A
            MOV     [rtcc],A
            MOV     A,vib_l_def1
            MOV     [RTC_HI],A
            MOV     [VIB_VOH],A
            CLR     [PW_RAM1]
            SET     [LED_AR1].pwr_led
            SET     [LED_AR1].vib_10
            CALL    init15m             ;NN
            MOV     A,4
            MOV     [STP_CNT],A
            CLR     [RTCC]
            MOV     A,10010000B
            MOV     [TMRC],A
            MOV     A,00000101B
            MOV     INTC,A
              ;*****************
loop:
            CALL    scan_ky
            CALL    led_prc
            SZ      [FLAG].key_ok
            CALL    key_prc
waitloop:
            JMP     waitloop
              ;*******************
            END
```

It is understood, of course, that while the forms of the invention herein shown and described include the best mode contemplated for carrying out the present invention, they are not intended to illustrate all possible forms thereof.

What is claimed is:

1. A massaging apparatus comprising:

a foam cushion defining a plurality of spatially separated regions each region having a foam core with a plurality of apertures;

at least one electric DC motor disposed in each of the plurality of apertures for rotating in response to an electrical signal to provide localized vibration to an associated region of the cushion;

a hand-held controller in electrical communication with the DC motors, the controller including:

a microprocessor executing program instructions for receiving input from a user indicative of a desired vibration intensity, duration, and region for selectively energizing the DC motors based on the desired intensity, duration, and region by generating a pulse train including a plurality of groups of pulses separated by regular intervals of no pulses where each pulse has a variable duty cycle based on the desired intensity and each group of pulses has a number of pulses based on the desired duration, the microprocessor including a plurality of input/output ports;

a plurality of indicator lights each corresponding to one of the plurality of regions, the indicator lights being in electrical communication with the microprocessor; and a plurality of input devices for selecting at least an operating mode and an intensity of vibration, the input devices being in electrical communication with the microprocessor, wherein the number of indicator lights added to the number of input devices exceeds the total number of input/output ports of the microprocessor.

2. The apparatus of claim 1 wherein at least two of the plurality of input devices are connected to a single one of the plurality of input/output ports.

3. The apparatus of claim 1 wherein at least two of the plurality of indicator lights are connected to a single one of the input/output ports.

4. The apparatus of claim 1 wherein at least a portion of the input/output ports of the microprocessor are configurable and wherein the microprocessor includes program instructions to selectively configure the input/output ports so as to accommodate a number of inputs and outputs which exceeds the number of input/output ports.

5. The apparatus of claim 1 wherein the hand-held controller further comprises:

a timer for selectively generating a periodic reminder signal for at least one of the plurality of vibrators indicating that the apparatus is energized and none of the regions is selected.

6. A massaging apparatus comprising:

a foam cushion defining a plurality of spatially separated regions each region having a foam core with a plurality of apertures;

at least one electric DC motor disposed in each of the plurality of apertures, the DC motor including an eccentrically mounted weight for rotating in response to an electrical signal to provide localized vibration to an associated region of the cushion;

a hand-held controller in electrical communication with the DC motors, the controller including:

a microprocessor executing program instructions for receiving input from a user indicative of a desired vibration intensity, duration, and region for selectively energizing the DC motors based on the desired intensity, duration, and region by generating a pulse train including a plurality of groups of pulses separated by regular intervals of no pulses where each pulse has a variable duty cycle based on the desired intensity and each group of pulses has a number of pulses based on the desired duration, the microprocessor including a plurality of input/output ports;

a plurality of indicator lights each corresponding to one of the plurality of regions, at least two of the indicator lights being in electrical communication with a single one of the input/output ports of the microprocessor; and a plurality of input devices for selecting at least an operating mode and an intensity of vibration, at least two of the input devices being in electrical communication with a single one of the input/output ports of the microprocessor.

* * * * *